United States Patent [19]

Goldman

[11] Patent Number: 4,821,960

[45] Date of Patent: Apr. 18, 1989

[54] SHOWER HEAD AND DECORATIVE COVERING THEREFOR

[76] Inventor: Budd S. Goldman, 43 Stanford Ct., Wantagh, N.Y. 11793

[21] Appl. No.: 178,494

[22] Filed: Apr. 7, 1988

[51] Int. Cl.[4] ..... B05B 15/00

[52] U.S. Cl. ..... 239/211; 239/587; 239/602; D23/222

[58] Field of Search ..... 239/288, 288.3, 288.5, 239/588, 428.5, 211, 587, 602; D23/34, 35, 36; 4/661; 285/261, 45

[56] References Cited

U.S. PATENT DOCUMENTS

| | | | |
|---|---|---|---|
| 84,900 | 8/1931 | Moran | D23/213 |
| 116,946 | 10/1939 | Freeman | D23/222 |
| 123,979 | 2/1955 | Crenshaw | D23/223 |
| 177,675 | 5/1956 | Hurwitz | D23/223 |
| 183,342 | 8/1958 | Falcetti | D23/222 |
| 224,532 | 8/1972 | Michels | D23/222 |
| 234,198 | 1/1975 | DuBois | D23/223 |
| 268,611 | 4/1983 | Klose | D23/35 |
| D. 282,563 | 2/1986 | Beene | D23/256 |
| 1,918,874 | 7/1933 | Shannahan | 239/211 |
| 3,092,334 | 6/1963 | Peterson | 239/288.5 |
| 3,994,138 | 3/1976 | Easton | 239/18 |
| 4,353,139 | 10/1982 | Wainwright et al. | 4/661 |

*Primary Examiner*—Duane A. Reger
*Assistant Examiner*—Kevin P. Weldon
*Attorney, Agent, or Firm*—Frishauf, Holtz, Goodman & Woodward

[57] ABSTRACT

A covering for a shower head includes a hollow body adapted to be placed over a shower head. The hollow body has a through hole extending therethrough, the through hole having dimensions to permit receipt of the shower head therein. A first bearing surface is formed in the hollow body for contactingly engaging the shower head, the first bearing surface defining a portion of the through hole; and a second bearing surface is formed in the hollow body in spaced relation to the first bearing surface for also contactingly engaging the shower head at an area spaced from the position where the first bearing surface engages the shower head, the second bearing surface defining another portion of the through hole. The first and second bearing surfaces stably support the covering on the shower head. The hollow body also includes a drain hole at a lower portion thereof for drainage of water therefrom.

30 Claims, 2 Drawing Sheets

SHOWER HEAD AND DECORATIVE COVERING THEREFOR

BACKGROUND OF THE INVENTION

This invention relates generally to shower heads, and more particularly, is directed to a combination shower head and decorative covering therefor.

The use of decorative and protective coverings for shower heads and other water fixtures are known in the art. For example, U.S. Pat. No. 4,353,139 discloses a protective cover for individual water fixtures. Specifically, each cover has a tubular section that fits over the water fixture and an enlarged head, for example, in the form of an animal head, that closes off the foremost extended end of the tubular section. The water exits through an opening provided at the end of the tubular section adjacent the enlarged head.

U.S. Pat. No. Des. 268,611 discloses a hand shower formed in the configuration of a snake, with the shower head being exposed through the snake's mouth. In like manner, U.S. Pat. No. Des. 173,979 discloses an elephant's head at the end of a shower hose, with the shower head being exposed through the elephant's trunk.

Other arrangements are shown in U.S. Pat. Nos. Des. 84,900; 116,946; 177,675; 183,342; 224,532; and 234,198; and U.S. Pat. No. 3,944,138.

OBJECTS OF THE INVENTION

It is an object of the present invention to provide a combination shower head and covering therefor.

It is another object of the present invention to provide a combination shower head and covering therefor in which the covering has two bearing surfaces that mount the covering on the shower head in a stable, non-drooping manner.

It is still another object of the present invention to provide a combination shower head and covering therefor in which the covering is hollow, thereby rendering the covering lighter and inexpensive to manufacture.

It is yet another object of the present invention to provide a combination shower head and covering therefor in which a rear portion of the covering is hollowed out to permit swiveling of the shower head to adjust the angle thereof.

It is a further object of the present invention to provide a combination shower head and covering therefor in which the covering is in the form of either a human head, an animal head, a flower or other ornamental design.

It is a still further object of the present invention to provide a combination shower head and covering therefor in which the facial expression on the animal or human head of the covering can be changed by moving the bearing surfaces thereof toward and away from each other.

It is a yet further object of the present invention to provide a combination shower head and covering therefor in which a drain hole is provided at a lower portion of the covering to permit drainage of water therefrom.

The above and other objects, features and advantages of the present invention will become readily apparent from the following detailed description which is to be read in connection with the accompanying drawings.

SUMMARY OF THE INVENTION

In accordance with an aspect of the present invention, a covering for a shower head includes a hollow body; a through hole extending through the hollow body, the through hole having dimensions to permit receipt of the shower head therein; first bearing means formed in the hollow body for engaging the shower head, the first bearing means defining a portion of the through hole; and second bearing means formed in the hollow body in spaced relation to the first bearing means for engaging the shower head, the second bearing means defining another portion of the through hole; wherein the first and second bearing means stably support the covering on the shower head.

In accordance with another aspect of the present invention, a combination shower head and covering therefor, includes a shower head; a hollow body; a through hole extending through the hollow body, the through hole having dimensions to permit receipt of the shower head therein; first bearing means formed in the hollow body for engaging the shower head, the first bearing means defining a portion of the through hole; and second bearing means formed in the hollow body in spaced relation to the first bearing means for engaging the shower head, the second bearing means defining another portion of the through hole; wherein the first and second bearing means stably support the covering on the shower head.

DETAILED DESCRIPTION

Figure 1:
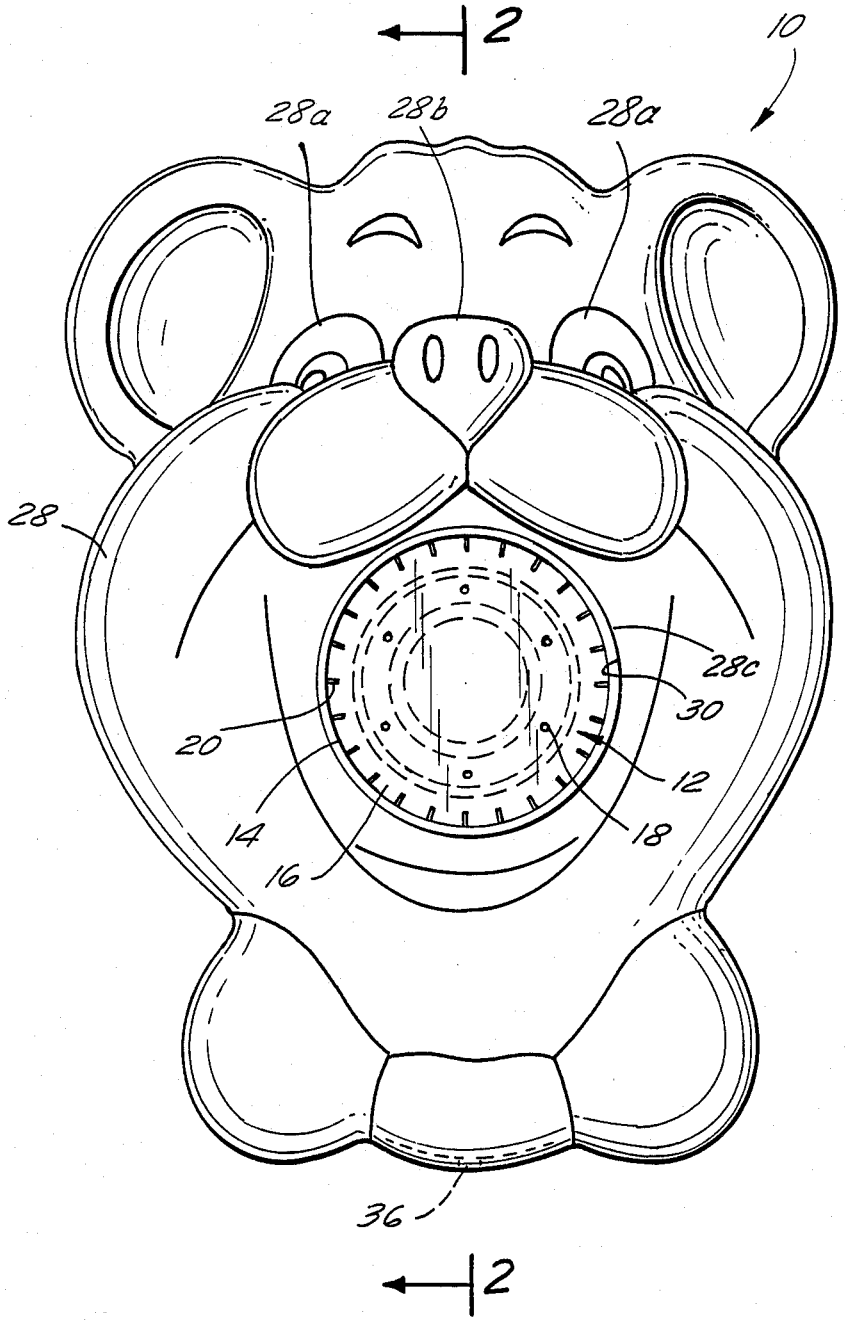
FIG. 1 is a front elevational view of a decorative covering according to the present invention, shown mounted on a shower head.

Referring to the drawings in detail, a decorative covering 10 according to the present invention is intended to be mounted on a shower head 12. Shower head 12 is a conventional shower head and includes a main body 14 that has a through bore (not shown) extending end-to-end therethrough. The distal end **14*a* of main body 14 has an end plate 16 secured thereto, end plate 16 having a plurality of small holes 18 and/or slots 20 through which water can escape in a conventional manner. Although main body 14** is shown having a somewhat parabolic shape, it will be appreciated that the present invention is not limited thereby.

A screw-threaded connector 22 has a ball and socket-type swivel connector 24 at one end thereof which connects screw-threaded connector 22 to main body 14. The opposite end of screw-threaded connector 22 has internal threads (not shown) which screw-threadedly secure screw-threaded connector 22 to the threaded end of a shower pipe 26 which supplies water under pressure thereto. Because of the swivel connection of connector 22 to main body 14, the direction of aim of water from main body 14 can be easily changed, in a conventional manner.

Covering 10 is formed by a hollow body 28, preferably in the shape of an animal or human head, although hollow body 28 is not limited by such shapes and, for example, hollow body 28 can have the shape of a flower or other ornamental design. Thus, when formed in the shape of the bear's head of FIG. 1, hollow body 28 is formed with two eyes 28*a*, a nose 28*b* and a mouth 28*c*. Because of the hollow nature of body 28, the amount of material that is used is reduced. As a result, hollow body is relatively light and inexpensive to manufacture and transport. Since covering 10 is light, no undue weight or stress is applied to shower pipe 26. Hollow body 28 is preferably made of a deformable and somewhat resilient rubber or rubber-like material.

Figure 2:
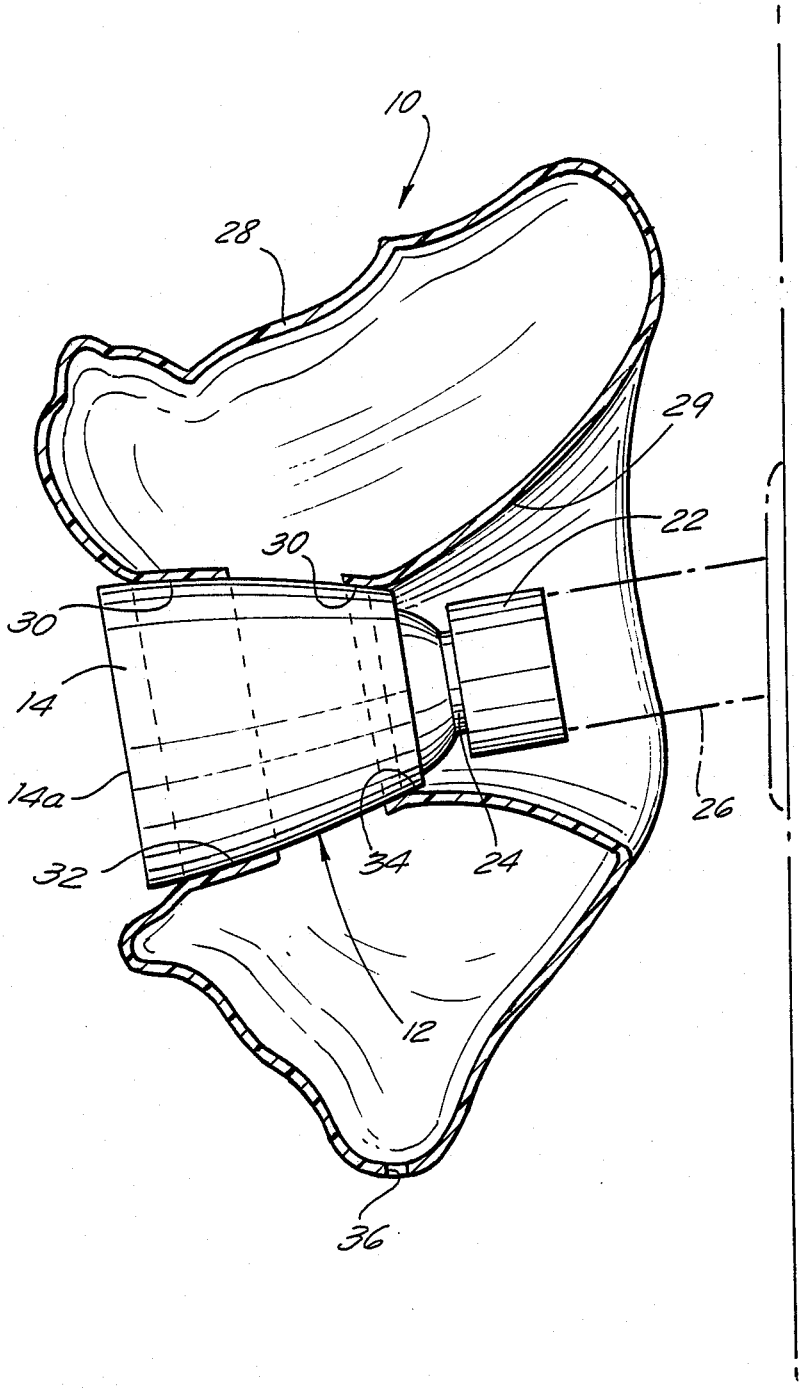
FIG. 2 is a cross-sectional view of the decorative covering and shower head of FIG. 1, taken along line 2—2 thereof.

As best shown in FIG. 2, hollow body 28 is cut away to form a through bore 30 extending end-to-end through hollow body 28, through bore 30 defining mouth 28*c* when hollow body 28 is formed in the shape of an animal or human head. In this regard, hollow body 28 includes first and second annular bearing surfaces 32 and 34, respectively, which are spaced from each other in the axial direction of through bore 30 and which define through bore 30. In the preferred embodiment of the present invention, annular bearing surface 32 has a larger diameter than annular bearing surface 34 to take into account the parabolic or curved shape of main body 14 of shower head 12. However, it will be appreciated that the relative dimensions of first and second bearing surfaces 32 and 34 will change in accordance with changes in the shape of shower head 12. Specifically, the diameter of bearing surfaces 32 and 34 are equal or slightly less than the outer diameters of respective areas on shower head 12 such that bearing surfaces 32 and 34 grip and engage shower head 12. Bearing surfaces 32 and 34 are formed by inwardly bent portions of hollow body 28, thereby providing bearing surfaces 32 and 34 as large flange-like surfaces having large areas of contact with shower head 12. Because of the deformable and resilient nature of hollow body 28, and therefore, of bearing surfaces 32 and 34, the bearing surfaces can deform slightly to tightly engage with shower head 12.

Because of this arrangement in which two spaced apart bearing surfaces are used, there are two different surfaces which grip shower head 12. As a result, there is no tilting or drooping of covering 10 on shower head 12. It will be appreciated that this secure attachment of covering 10 on shower head 12 occurs only by means of two bearing surfaces thereof which preferably form a tight fit over the outer surface of shower head 12.

Preferably, first bearing surface 32, which is the frontmost bearing surface, is inclined downwardly a small amount to provide better orientation of shower head 12 therein.

Further, because of the deformable nature of hollow body 28, when hollow body 28 is mounted to shower head 12, as aforementioned, first and second bearing surfaces 32 and 34 can be pushed toward each other. In such case, first and second bearing surfaces 32 and 34 will still engage and grip the same areas on shower head 12. However, the remainder of hollow body 28 will deform. Therefore, when hollow body 28 is in the shape of a human or animal head, the facial expression thereof will change when first and second bearing surfaces 32 and 34 are pushed toward each other to provide a different appearance. Such deformation will generally be maintained until bearing surfaces 32 and 34 are pulled apart.

In order to permit swiveling of shower head 12 by means of swivel connector 24, hollow body 28 includes a hollowed out rear section 29 which permits swiveling of main body 14 with respect to screw-threaded connector 22. Such hollowed out rear section 29 also provides clearance for shower pipe 26.

Because body 28 is hollow, water from shower head 12 may tend to accumulate in hollow body 28. Accordingly, a small drain hole 36 is provided at a lower portion (preferably the lowermost portion) of hollow body 28 to permit drainage of water from hollow body.

Having described a specific preferred embodiment of the invention with reference to the accompanying drawings, it will be appreciated that the present invention is not limited to that precise embodiment, and that various changes and modifications may be effected therein by one of ordinary skill in the art without departing from the scope or spirit of the invention as defined in the appended claims.

What is claimed is:

1. A covering for a shower head, comprising:

a hollow body;

a through hole extending through said hollow body, said through hole having dimensions to permit receipt of said shower head therein;

first bearing means formed in said hollow body for contactingly engaging the shower head, said first bearing means defining a portion of said through hole; and second bearing means formed in said hollow body in spaced relation to said first bearing means for contactingly engaging the shower head, said second bearing means defining another portion of said through hole;

said hollow body having a hollow portion between said first and second bearing means which is spaced from and out of contact with said shower head, said hollow portion surrounding at least a portion of the length of said shower head;

wherein said first and second bearing means stably support said covering on said shower head.

2. A covering according to claim 1, wherein said first bearing means includes a first annular bearing surface formed in said hollow body.

3. A covering according to claim 2, wherein said second bearing means includes a second annular bearing surface formed in said hollow body in spaced relation to said first annular bearing surface.

4. A covering according to claim 3, wherein each of said first and second bearing surfaces are formed by inwardly directed portions of said hollow body so as to form said bearing surfaces with large areas of engagement on said shower head.

5. A covering according to claim 1, wherein said hollow body is made from a deformable material.

6. A covering according to claim 1, wherein said hollow body has a configuration of a head with eyes, a nose and a mouth, and said through bore defines said mouth.

7. A covering according to claim 1, wherein:

the shower head includes a main body, screw-threaded connector means for connecting the main body to a shower pipe, and swivel connector means for connecting the main body to the screw-threaded connector means in a swivel manner; and said hollow body includes a hollowed-out rear section to permit swiveling of said main body with respect to said screw-threaded connector means.

8. A covering according to claim 1, wherein said hollow body includes a drain hole at a lower portion thereof to permit drainage of water from said hollow body.

9. A combination shower head and covering therefor, comprising:

a shower head;
a hollow body;
a through hole extending through said hollow body, said through hole having dimensions to permit receipt of said shower head therein;
first bearing means formed in said hollow body for contactingly engaging the shower head, said first bearing means defining a portion of said through hole; and
second bearing means formed in said hollow body in spaced relation to said first bearing means for contactingly engaging the shower head, said second bearing means defining another portion of said through hole;
said hollow body having a hollow portion between said first and second bearing means which is spaced from and out of contact with said shower head, said hollow portion surrounding at least a portion of the length of said shower head;
wherein said first and second bearing means stably support said covering on said shower head.

10. A combination shower head and covering according to claim 9, wherein said first bearing means includes a first annular bearing surface formed in said hollow body.

11. A combination shower head and covering according to claim 10, wherein said second bearing means includes a second annular bearing surface formed in said hollow body in spaced relation to said first annular bearing surface.

12. A combination shower head and covering according to claim 11, wherein each of said first and second bearing surfaces are formed by inwardly directed portions of said hollow body so as to form said bearing surfaces with large areas of engagement on said shower head.

13. A combination shower head and covering according to claim 9, wherein said hollow body is made from a deformable material.

14. A combination shower head and covering according to claim 9, wherein said hollow body has a configuration of a head with eyes, a nose and a mouth, and said through bore defines said mouth.

15. A combination shower head and covering according to claim 9, wherein:
said shower head includes a main body, screw-threaded connector means for connecting said main body to a shower pipe, and swivel connector means for connecting said main body to said screw-threaded connector means in a swivel manner; and
said hollow body includes a hollowed-out rear section to permit swiveling of said main body with respect to said screw-threaded connector means.

16. A combination shower head and covering according to claim 9, wherein said hollow body includes a drain hole at a lower portion thereof to permit drainage of water from said hollow body.

17. A covering for a shower head, comprising:
a hollow body;
a through hole extending through said hollow body, said through hole having dimensions to permit receipt of said shower head therein;
first bearing means formed in said hollow body for engaging the shower head, said first bearing means defining a portion of said through hole, and said first bearing means including a first annular bearing surface formed in said hollow body; and
second bearing means formed in said hollow body in spaced relation to said first bearing means for engaging the shower head, said second bearing means defining another portion of said through hole, and second bearing means including a second annular bearing surface formed in said hollow body in spaced relation to said first annular bearing surface;
wherein said first and second bearing means stably support said covering on said shower head.

18. A covering according to claim 17, wherein each of said first and second bearing surfaces are formed by inwardly directed portions of said hollow body so as to form said bearing surfaces with large areas of engagement on said shower head.

19. A covering according to claim 17, wherein said hollow body is made from a deformable material.

20. A covering according to claim 17, wherein:
the shower head includes a main body, screw-threaded connector means for connecting the main body to a shower pipe, and swivel connector means for connecting the main body to the screw-threaded connector means in a swivel manner; and
said hollow body includes a hollowed-out rear section to permit swiveling of said main body with respect to said screw-threaded connector means.

21. A covering according to claim 17, wherein said hollow body includes a drain hole at a lower portion thereof to permit drainage of water from said hollow body.

22. A covering for a shower head, comprising:
a hollow body;
a through hole extending through said hollow body, said through hole having dimensions to permit receipt of said shower head therein;
first bearing means formed in said hollow body for engaging the shower head, said first bearing means defining a portion of said through hole; and
second bearing means formed in said hollow body in spaced relation to said first bearing means for engaging the shower head, said second bearing means defining another portion of said through hole;
wherein said first and second bearing means stably support said covering on said shower head; and
said hollow body having a drain hole at a lower portion thereof to permit drainage of water from said hollow body.

23. A covering according to claim 22, wherein said hollow body is made from a deformable material.

24. A combination shower head and covering therefor, comprising:
a shower head;
a hollow body;
a through hole extending through said hollow body, said through hole having dimensions to permit receipt of said shower head therein;
first bearing means formed in said hollow body for engaging the shower head, said first bearing means defining a portion of said through hole, and said first bearing means including a first annular bearing surface formed in said hollow body; and
second bearing means formed in said hollow body in spaced relation to said first bearing means for engaging the shower head, said second bearing means defining another portion of said through hole, and said second bearing means including a second annular bearing surface formed in said hollow body in spaced relation to said first annular bearing surface;

wherein said first and second bearing means stably support said covering on said shower head.

25. A combination shower head and covering according to claim 24, wherein each of said first and second bearing surfaces are formed by inwardly directed portions of said hollow body so as to form said bearing surfaces with large areas of engagement on said shower head.

26. A combination shower head and covering according to claim 24, wherein said hollow body is made from a deformable material.

27. A combination shower head and covering according to claim 24, wherein:

said shower head includes a main body, screw-threaded connector means for connecting said main body to a shower pipe, and swivel connector means for connecting said main body to said screw-threaded connector means in a swivel manner; and said hollow body includes a hollowed-out rear section to permit swiveling of said main body with respect to said screw-threaded connector means.

28. A combination shower head and covering according to claim 24, wherein said hollow body includes a drain hole at a lower portion thereof to permit drainage of water from said hollow body.

29. A covering for a shower head, comprising:

a hollow body;

a through hole extending through said hollow body, said through hole having dimensions to permit receipt of said shower head therein;

first bearing means formed in said hollow body for engaging the shower head, said first bearing means defining a portion of said through hole; and second bearing means formed in said hollow body in spaced relation to said first bearing means for engaging the shower head, said second bearing means defining another portion of said through hole;

wherein said first and second bearing means stably support said covering on said shower head; and said hollow body includes a drain hole at a lower portion thereof to permit drainage of water from said hollow body.

30. A combination shower head and covering according to claim 29, wherein said hollow body is made from a deformable material.

* * * * *